US005935742A

United States Patent [19]

Wang et al.

[11] Patent Number: 5,935,742

[45] Date of Patent: Aug. 10, 1999

[54] PHOTOGRAPHIC MATERIAL HAVING A PROCESSED PHOTOGRAPHIC ELEMENT IN A CASSETTE

[75] Inventors: Yongcai Wang, Penfield; Dennis Edward Smith; Alfred Bruce Fant, both of Rochester; Melvin Michael Kestner, Hilton, all of N.Y.

[73] Assignee: Eastman Kodak Company, Rochester, N.Y.

[21] Appl. No.: 08/633,384

[22] Filed: Apr. 16, 1996

Related U.S. Application Data

[60] Provisional application No. 60/005,691, Sep. 25, 1995.

[51] Int. Cl.[6] ..... G03C 3/00

[52] U.S. Cl. ..... 430/9; 430/523; 430/950; 430/961; 430/642; 430/531; 430/533; 430/536; 430/537

[58] Field of Search ..... 430/9, 523, 950, 430/961, 531, 533, 536, 537, 642

[56] References Cited

U.S. PATENT DOCUMENTS

| | | | |
|---|---|---|---|
| 4,142,894 | 3/1979 | Hori et al. | 430/950 |
| 4,447,525 | 5/1984 | Vallarino et al. | 430/523 |
| 4,992,357 | 2/1991 | Haga et al. | 430/537 |
| 5,279,934 | 1/1994 | Smith et al. | 430/950 |
| 5,370,982 | 12/1994 | Tashiro et al. | 430/536 |
| 5,378,577 | 1/1995 | Smith et al. | 430/961 |
| 5,550,011 | 8/1996 | Fant et al. | 430/523 |
| 5,595,862 | 1/1997 | Fant et al. | 430/537 |

*Primary Examiner*—Geraldine Letscher

*Attorney, Agent, or Firm*—Carl F. Ruoff; Robert A. Gerlach

[57] ABSTRACT

A photographic material comprising a cassette containing a processed photographic element, the photographic element comprising a support, at least one light sensitive silver halide layer and a protective overcoat layer on the light sensitive layer, the protective overcoat layer comprising a hydrophilic binder and permanent matte particles, the permanent matte particles comprising greater than 80 mole percent methyl methacrylate and having a mean particle size of from 1 to 1.8 $\mu$m and a coating weight of from 70 to 250 mg/m$^2$.

10 Claims, 1 Drawing Sheet

PHOTOGRAPHIC MATERIAL HAVING A PROCESSED PHOTOGRAPHIC ELEMENT IN A CASSETTE

CROSS REFERENCE TO RELATED APPLICATION

Reference is made to an priority claimed from U.S. Provisional application Ser. No. US 60/005,691, filed Sep. 25, 1995, entitled PHOTOGRAPHIC MATERIAL HAVING PROCESSED PHOTOGRAPHIC ELEMENT IN A CASSETTE.

FIELD OF THE INVENTION

This invention relates to a photographic material and particularly to a photographic material having a processed photographic element in a cassette.

BACKGROUND OF THE INVENTION

It is conventional to incorporate finely powdered grains or matting agents into the protective layer of a photographic element to increase the surface roughness to achieve the following: (1) reduce self-adhering of the material, (2) reduce sticking of the material to manufacturing and processing devices, (3) improve the antistatic properties of the material, and (4) improve the vacuum adhesiveness of the material in contact exposure to prevent Newton's rings. The matting agents are commonly very small particles of organic or inorganic materials, such as silicone dioxide, magnesium oxide, titanium dioxide, calcium carbonate, poly(methyl methacrylate), poly(vinyltoluene), poly(methyl methacrylate-co-methacrylic acid), and so on.

Matting of the protective layer suffers, however, from various disadvantages. For example, it reduces the transparency of the photographic elements after processing and increases the graininess of the picture. It has been heretofore known to include processing removable polymer particles, sometimes referred to as soluble matte, in protective layers. High concentrations of processing removable matte are needed especially when the unprocessed photographic elements are used or stored at high relative humidities and at elevated temperatures of from 30 to 40° C. High concentrations are also needed to prevent contact specks which cause adverse sensitometric defects when the unprocessed materials are rolled up.

The use of a high level of processing removable matte provides a satisfactory solution to conventional films for amateur use, for which the processed, or developed, film strips are returned to the consumer in synthetic resin pouches, or sleeves, where the frontside and backside of the film do not come in contact with each other.

Recent patents have disclosed photographic systems where the processed element may be re-introduced into a cassette. This system allows for compact and clean storage of the processed element until such time when it may be removed for additional prints or to interface with display equipment. Storage in the cassette is preferred to facilitate location of the desired exposed frame and to minimize contact with the negative during subsequent usage. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which results in ferrotyping, especially at high temperature and high relative humidity. Processing removable matte does not prevent this problem.

In recent years, rapid processing and high temperature drying after processing have become common practice for photographic materials. The high temperature dried films, for example 60° C. (harsh drying), tend to aggravate ferrotyping which results from close contact, especially under elevated humidity and temperature. When ferrotyping is sufficiently severe, the resulting prints are unacceptable. Films dried at lower temperatures, for example 40° C. (mild drying), tend to show much less ferrotyping. The reason for this difference is not understood.

SUMMARY OF THE INVENTION

An object of this invention is to provide a cassette which contains a processed photographic element with excellent image quality and superior resistance to sticking and ferrotyping between front and back sides even at high temperatures and in moist environments.

The invention provides a photographic material comprising a cassette containing a processed photographic element, the photographic element comprising a support; at least one light sensitive silver halide layer and a protective overcoat layer on the light sensitive layer, the protective overcoat layer comprising a hydrophilic binder and permanent matte particles, the permanent matte particles comprising greater than 80 mole percent methyl methacrylate and having a mean particle size of from 1 to 1.8 $\mu$m and a coating weight of from 70 to 250 mg/m$^2$.

The photographic material in accordance with this invention is surprisingly insensitive to drying conditions in a photographic processor, and the good ferrotyping protection is therefore retained even when the element is treated with harsh drying. Further, the processed photographic element demonstrates expectedly low graininess.

DESCRIPTION OF PREFERRED EMBODIMENTS

Figure 1:
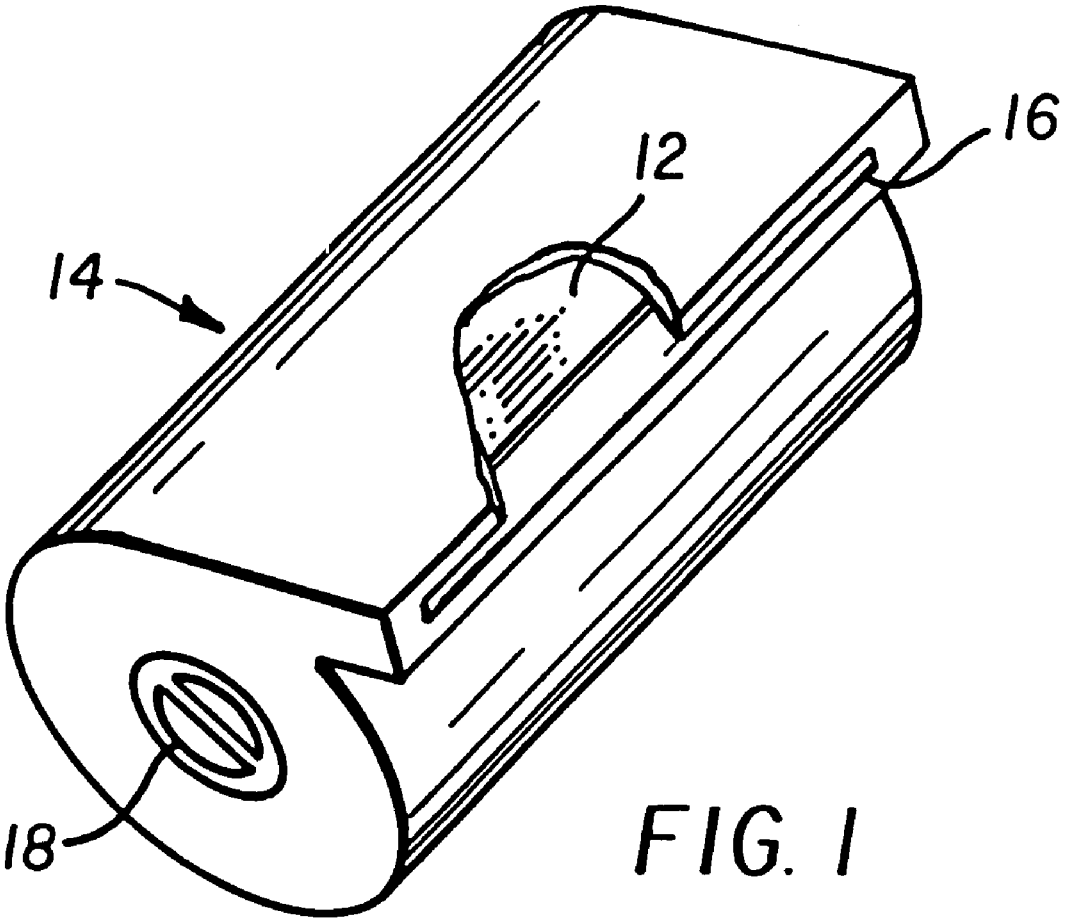
FIG. 1 is a partially cutaway perspective view of a cassette containing a processed photographic element in accordance with this invention.

The photographic material in accordance with this invention includes a processed photographic element in a cassette as shown generally in U.S. Pat. No. 5,173,730 and in the attached FIG. 1. In FIG. 1, the film material includes a processed photographic element 12 encased in a suitable cassette 14. The cassette includes an inlet/outlet 16 for entrance and exit of the photographic element 12 into and out of the cassette 14. The photographic element 12 may be wound upon a suitable spool 18 or on itself (not shown).

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate) film, polycarbonate film, and the like.

In accordance with the present invention, the processed photographic element includes a protective overcoat containing matte particles in a hydrophilic binder. The matte particles have a mean particle size of from 1.0 to 1.8 μm and preferably 1.2 to 1.8 μm. By "mean particle size" is meant the equivalent spherical diameter calculated from the volume average distribution. The matte is used at a coating weight of from 70 to 250 mg/m$^2$, and preferably from 70 to 150 mg/m$^2$. Furthermore, the matte particles used in the present invention should have a narrow size distribution. Any appreciable amount of oversized particles can adversely affect image quality. Any appreciable amount of undersized particles can reduce the transparency of the layer. Preferably, 95 percent by weight of the matte particles range from 0.8 to 3.5 micrometers.

The protective overcoat layer of the present invention can be coated directly on the top of a light sensitive layer or can be used together with an ultraviolet ray protective layer or an interlayer. In general, the outermost protective layer of the present invention has a thickness of from 0.2 to 3 μm, and preferably from 0.5 to 2 μm, and most preferably from 0.6 to 1.5 μm. A very thick protective layer will diminish the matting effect and a very thin layer will adversely affect the matte particle adhesion.

The matte particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley (1981); and W. P. Sorenson and T. W. Campbell in "Preparation Method of Polymer Chemistry", 2nd Ed, Wiley (1968)). A suitable method of preparing matte particles in accordance with this invention is by a limited coalescence technique where polyaddition polymerizable monomer or monomers are added to an aqueous medium containing a particlulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference. A preferred method of preparing matte particles in accordance with this invention is by a process including forming a suspension or dispersion of ethylenically unsaturated monomer droplets in an aqueous media, subsequent to the formation of the droplets and before the commencement of the polymerization reaction, adding to the aqueous media an effective amount of a hydrophilic colloid such as gelatin and polymerizing the monomer to form solid polymer particles.

The matte particles of the present invention contain greater than 80 mole percent methyl methacrylate. For example, the matte particles can be heterogeneous, containing other addition polymers, condensation polymers, inorganic fillers, and the like. Inorganic fillers, for example, include silicon dioxide, tin oxide, antimony doped tin oxide, aluminum oxide, iron oxide, metal antimonates, and the like. Suitable condensation polymers include polyesters, polyurethanes, polycarbonates, polyamides, polyanalines, polythiophenes, and the like. Suitable polyaddition polymers include any of those made from the following ethylenically unsaturated monomers including acrylic monomers, including acrylic acid, or methacrylic acid, and their alkyl esters such as ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, acrylamide and methacrylamide; vinyl monomers, such as, vinyl acetate, vinyl propionate, vinylidene chloride, vinyl chloride, and vinyl aromatic compounds such as styrene, t-butyl styrene and vinyl toluene. Other comonomers which may be used in combination with any of the foregoing monomers include dialkyl maleates, dialkyl itaconates, dialkyl methylene-malonates, isoprene, and butadiene. In addition, crosslinking comonomers can be used to crosslink the polymer particles of the present invention to effectively increase the glass transition temperature of the particles. These are monomers which are polyfunctional with respect to the polymerization reaction, and include esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, dienes such as butadiene and isoprene, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The matte particles also may include mixtures of particles wherein 80 percent of the particles present in the mixture are polymethylmethacrylate and up to 20 percent of the particles can include any of the materials heretofore mentioned.

The matte particles may also be copolymers of greater than 80 mole percent of methyl methacrylate and up to 20 mole percent of any other ethylenically unsaturated monomers such as, for example, those set forth above.

Preferably, the matte particles of the present invention are a copolymer of methyl methacrylate and another ethylenically unsaturated monomer. More preferably, the copolymer is at least 90 mole percent methyl methacrylate. Most preferably, the matte particles are 100 mole percent methyl methacrylate.

The matte particle surface may include reactive functional groups which form covalent bonds with binders by intermolecular crosslinking or by reaction with a crosslinking agent (i.e. a hardener). Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

It is, of course, to be understood that while this invention relates to a photographic material including a processed photographic element in a cassette, the processed photographic element may be derived from an unprocessed element containing processing removable mattes used together with the matte particles in the practice of the invention. Such processing removable mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and α,β-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. Nos. 2,992,101; 3,767,448; 4,094,848; 4,447,525; and 4,524,131.

Any suitable hydrophilic binder can be used in practice of this invention, such as naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

Gelatin can be used together with other water dispersible polymers as binders in the practice of the present invention. The water dispersible polymers can be incorporated into either light sensitive or light-insensitive layers. Suitable water dispersible polymers include both synthetic and natural water dispersible polymers. Synthetic water dispersible polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, or a nonionic group and an anionic group in the molecular structure. The water dispersible polymers may be incorporated into the photographic materials of the present invention in an amount of preferably at least 0.5 percent, preferably from 1 to 50 percent, and most preferably from 2 to 30 percent based on the amount of the whole coated amount of gelatin on the side having a layer containing the matte particle of the present invention.

Water dispersible polymers useful for the present invention include vinyl polymer latex particles prepared by such as emulsion polymerization process, water-borne polyurethane dispersions, water-borne epoxy dispersions, water-borne polyester dispersions, and the like. The mean size of the dispersed particles is within the range of from 0.01 to 0.2 μm, preferably from 0.02 to 0.1 μm.

The binder should be chosen so that it effectively adheres the matte particles to the surface of the element. For crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

Any lubricant can be used in the outermost layer of the present invention. Typical lubricants include (1) silicone based materials disclosed, for example, in U.S. Pat. Nos. 3,489,567; 3,080,317; 3,042,522; 4,004,927; and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride), poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No. 308, published Dec. 1989, page 1006.

The protective overcoat layer useful in the practice of the invention may optionally contain surface active agents, antistatic agents, charge control agents, thickeners, ultraviolet ray absorbers, processing removable dyes, high boiling point solvents, silver halide particles, colloidal inorganic particles, magnetic recording particles, and various other additives.

The matte-containing layer useful in the practice of the invention can be applied by any of a number of well-known techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convection heating. Known coating and drying methods are described in further detail in Research Disclosure No. 308, Published Dec. 1989, pages 1007 to 1008.

The photographic element of the present invention can contain an electrically conductive layer, which can be either a surface protective layer or a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The protective overcoat layer in accordance with this invention may be positioned over a transparent magnetic recording layer as described in U.S. Pat. Nos. 5,395,743; 5,397,826; 5,113,903; 5,432,050; 5,434,037; and 5,436,120.

The present invention is also directed to a single-use camera having incorporated therein a photographic material as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the single-use camera to the consumer does not normally occur, however, the photographic material will be returned.

The photographic processing steps to which the raw film may be subject may include, but are not limited to the following:

(1) color developing→bleach-fixing→washing/stabilizing;

(2) color developing→bleaching→fixing→washing/stabilizing;

(3) color developing→bleaching→bleach-fixing→washing/stabilizing;

(4) color developing→stopping→washing→bleaching→washing→fixing→washing/stabilizing;

(5) color developing→bleach-fixing→fixing→washing/stabilizing;

(6) color developing→bleaching→bleach-fixing→fixing→washing/stabilizing;

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The following examples are intended to illustrate the present invention. However, it should be understood that the invention is not limited to these illustrative examples. The types and sizes of the matte particles used in the examples are listed in Table 1:

TABLE 1

MATTE PARTICLES

| ID | Composition | Mean Particle Size ($\mu$m) |
|---|---|---|
| P-1 | Poly(methyl methacrylate) | 0.8 |
| P-2 | Poly(methyl methacrylate) | 1.2 |
| P-3 | Poly(methyl methacrylate) | 1.5 |
| P-4 | Poly(methyl methacrylate) | 1.7 |
| P-5 | Poly(methyl methacrylate) | 2.2 |
| P-6 | Poly(methyl methacrylate) | 2.4 |
| P-7 | Poly(vinyl toluene) | 1.8 |
| P-8 | Poly(vinyl toluene-co-divinyl benzene) 80/20 | 1.5 |
| P-9 | Poly(methyl methacrylate-co-methacrylic acid) 45/55 | 3.0 |
| P-10 | Poly(ethyl methacrylate) | 1.8 |

EXAMPLES 1–6 AND COMPARATIVE SAMPLES A TO i

A series of photographic elements are prepared as follows: A poly(ethylene naphthalate) support having an antihalation layer on one side and an antistatic layer overcoated with a transparent magnetic recording layer on the other side is coated on the antihalation layer with the following imaging forming layers in sequence.

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 $\mu$m grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 $\mu$m grain size) (0.816 g/m$^2$ silver) and a red sensitive, tabular grain, silver bromoiodide emulsion (4.5 mole percent iodide) (0.98 $\mu$m diameter by 0.11 $\mu$m thick) (0.215 gm$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 $\mu$m diameter by 0.11 $\mu$m thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 $\mu$m diameter by 0.112 $\mu$m thick) (0.258 g/m$^2$ Ag), and a green sensitive, tabular grain, silver bromoiodide emulsion (1.3 mole percent iodide) (0.54 $\mu$m diameter by 0.086 $\mu$m thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 $\mu$m diameter by 0.12 $\mu$m thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-t-octyl-1, 4-dihydroxy benzene (0.075 g/m$^2$), YD-2 (0.108 g/m$^2$), Irganox 1076 sold by Ciba Geigy (0.01 g /m$^2$), S-2 (0.121 g/m$^2$) and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

UV Protective Layer: This layer comprises compound UV-1 (0.111 g/m2), UV-2 (0.111 g/m$^2$) S-4 (0.222 g/m$^2$), silver bromide Lippmann emulsion (0.215 g/m$^2$ Ag), and gelatin (0.7 g/m$^2$).

Y1

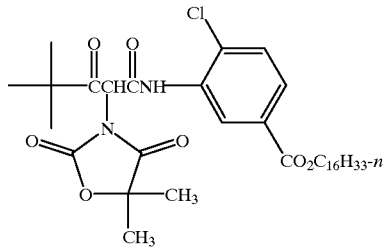

IR-1

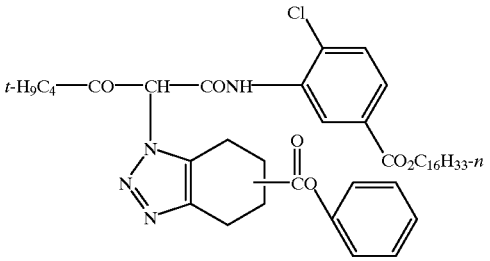

YD-2

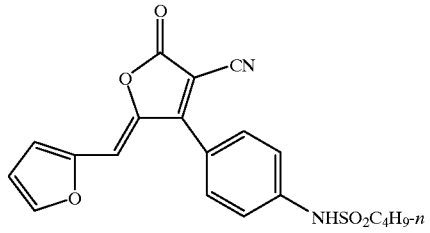

ST-1

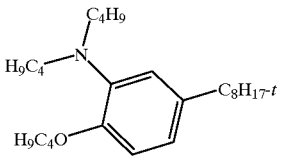

-continued
IR-2
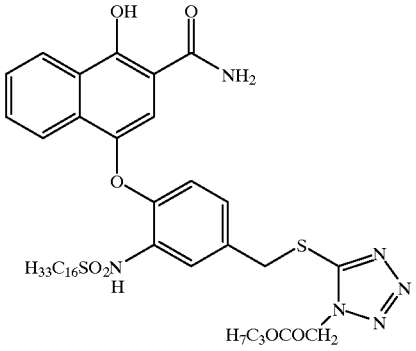
IR-3
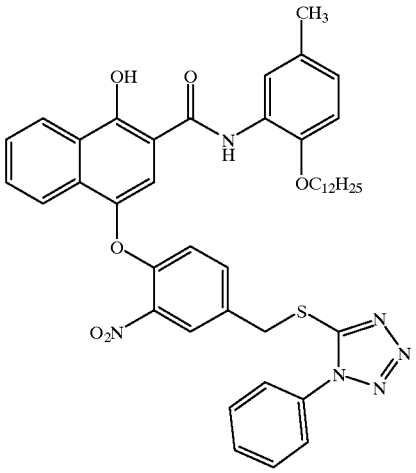
IR-4
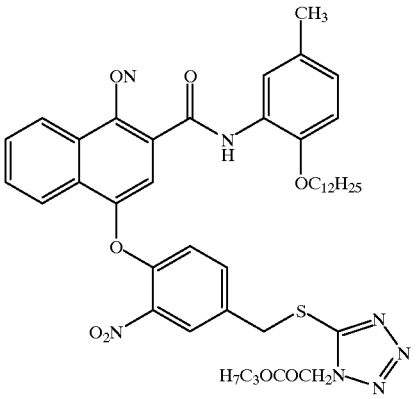
B-1
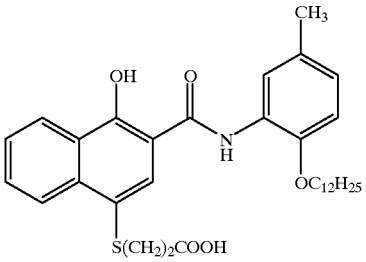

-continued
M-1
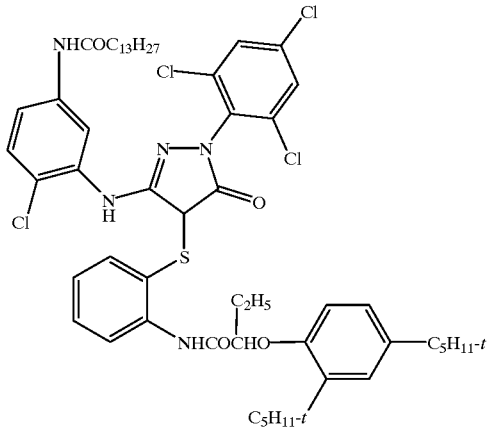
MM-1
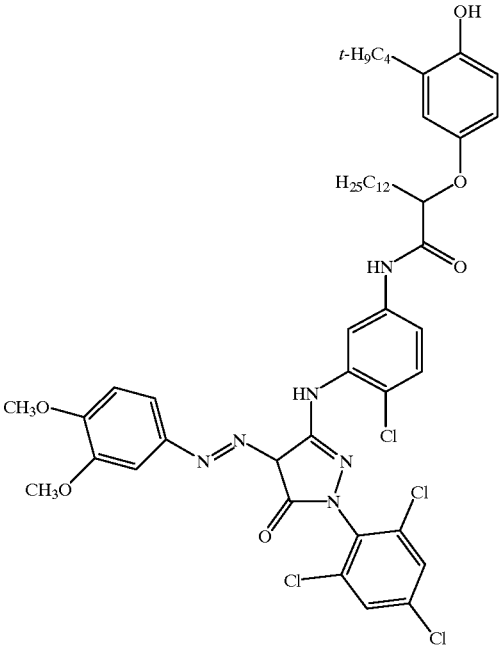
CC-1
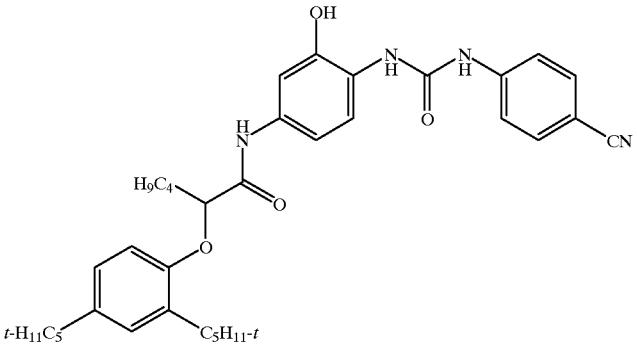

-continued
CM-1
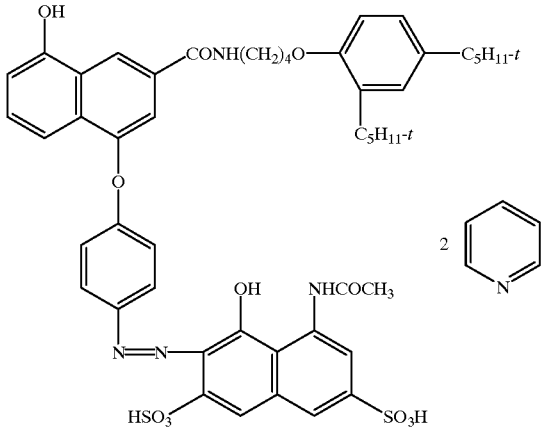
S-1
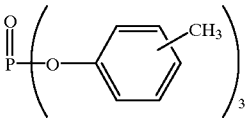
S-2
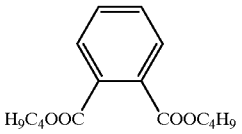
S-3
$C_{11}H_{23}CON(C_2H_5)_2$
S-4
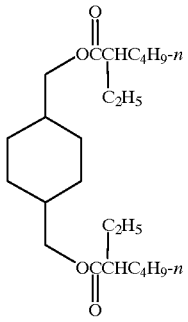
S-5
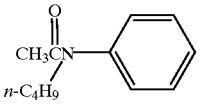
UV-1
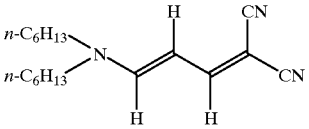

-continued

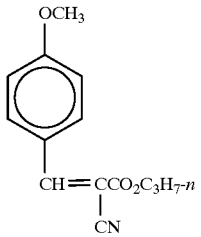

UV-2

Hydrophilic Protective Overcoat Layer

A protective overcoat layer containing gelatin binder and matting agents listed in Table 1 is coated on the top of the UV layer and has the following composition:

TABLE 2

| COMPOSITION OF THE PROTECTIVE OVERCOAT LAYER | (dry weight) |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Matte 1 (Table 3) | |
| Matte 2 (Table 3) | |

Table 3 shows the compositions of the protective overcoat layers of each photographic element prepared. Samples are comparative and Examples are in accordance with the invention.

TABLE 3

| | PROTECTIVE OVERCOAT LAYER | | | |
|---|---|---|---|---|
| COATING No. | Matte 1 | Coverage mg/m$^2$ | Matte 2 | Coverage mg/m$^2$ |
| Sample A | P-8 | 107.6 | — | — |
| Sample B | P-8 | 107.6 | P-9 | 107.6 |
| Sample C | P-7 | 107.6 | — | — |
| Sample D | P-10 | 107.6 | — | — |
| Sample E | — | — | P-9 | 107.6 |
| Sample F | P-3 | 53.8 | P-9 | 107.6 |
| Sample G | P-1 | 107.6 | — | — |
| Sample H | P-5 | 107.6 | — | — |
| Sample I | P-6 | 107.6 | — | — |
| Example 1 | P-2 | 107.6 | — | — |
| Example 2 | P-2 | 107.6 | P-9 | 107.6 |
| Example 3 | P-3 | 107.6 | — | — |
| Example 4 | P-3 | 107.6 | P-9 | 107.6 |
| Example 5 | P-4 | 107.6 | — | — |
| Example 6 | P-4 | 107.6 | P-9 | 107.6 |

Evaluation of the RMS Granularity

The graininess of a photographic picture is caused primarily by the developed dye clouds, image silver and light scatter from matting agents in the protective overcoat layers. The Root Mean Square (RMS) Granularity is evaluated by the method decribed in ANSI Ph 2.40 (1985) entitled "Root Mean Square (RMS) Granularity of Film (Images on One Side Only)-Method for Measurement". By comparing RMS Granularity of the listed samples with a film that contains no matte, the granularity due to the matte is determined. The test results are reported in Table 4.

Evaluation of Ferrotyping Resistance

A group of six 35 mm strips having a length of 305 mm (12 inches) of the feature film (raw or processed) are placed in a 70 percent or 80 percent relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 Kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 4.

TABLE 4

| Coating No. | Increase in RMS Granularity | Ferrotyping, Raw 80% RH/37.8° F. | Ferrotyping, Processed (Mild) 80% RH/37.8° C. | Ferrotyping, Processed (Harsh) 80% RH/37.8° C. |
|---|---|---|---|---|
| Sample A | 6 | A | A | B |
| Sample B | 6 | A | A | B |
| Sample C | 8 | A | A | B |
| Sample D | 6 | B | B | D |
| Sample E | 0 | A | D | D |
| Sample F | 1 | A | B | D |
| Sample G | 1 | B | B | D |
| Sample H | 5.5 | A | A | A |
| Sample I | 8 | A | A | A |
| Example 1 | 1 | A | A | B |
| Example 2 | 1 | A | A | B |
| Example 3 | 2 | A | A | B |
| Example 4 | 2 | A | A | B |
| Example 5 | 2.5 | A | A | A |
| Example 6 | 2.5 | A | A | A |

The comparison samples A to C contain styrenic matte particles in the upper protective layer. They have adquate ferrotyping protection both before and after processing. However, they have unacceptable RMS granularity. Sample D contains poly(ethyl methacrylate) matte and shows inferior performance in terms of both ferrotyping protection and film image quality. Sample E contains only processing removable matte and shows poor post process ferrotyping protection. Sample F contains 53.8 mg/m$^2$ of 1.5 $\mu$m poly (methyl methacrylate) P-3 matte (1.5 μm poly (methyl methacrylate) and 107.6 mg/m2 of P-9 matte (processing removable). Although it shows good RMS granularity, it has poor ferrotyping protection after processing, particularly under harsh drying. Sample G contains a 0.75 μm matte in the upper protective layer and shows good RMS granularity value but poor post processing ferrotyping protection. Samples H and I contain large poly(methyl methacrylate) matte particles (>1.8 μm) in the upper protective layer and have good post process ferrotyping protection but unacceptable RMS granularity. On the other hand, Examples 1 to 6 contain poly(methyl methacrylate) matte particles of the present invention and have unexpectedly superior performance in terms of good ferrotyping protection both before and after processing, in combination with unexpectedly low RMS granularity values.

What is claimed is:

1. A photographic material comprising a cassette containing a processed photographic element, the photographic element comprising a support, at least one light sensitive silver halide layer and a protective overcoat layer on the light sensitive layer, the protective overcoat layer comprising a hydrophilic binder and permanent matte particles, the permanent matte particles comprising greater than 80 mole percent methyl methacrylate and having a mean particle size of from 1 to 1.8 μm and a coating weight of from 70 to 250 $mg/m^2$.

2. The photographic material of claim 1 wherein the mean particle size is from 1.2 to 1.8 μm.

3. The photographic material of claim 1 wherein 95 percent by weight of the matte particles range from 0.8 to 3.5 μm.

4. The photographic material of claim 1 wherein the coating weight is from 70 to 150 $mg/m^2$.

5. The photographic material of claim 1 wherein the matte particles are 100 mole percent methyl methacrylate.

6. The photographic material of claim 1 wherein the support is cellulose acetate or polyester.

7. The photographic material of claim 6 wherein the polyester is polyethylene terephthalate, polyethylene naphthalate, copolymers thereof or mixtures thereof.

8. The photographic material of claim 1 wherein the processed photographic element in the cassette is wound upon itself.

9. The photographic material of claim 1 wherein the processed photographic element in the cassette is wound upon a spool.

10. The photographic material of claim 1 wherein the processed photographic element contains a transparent magnetic recording layer.

* * * * *